United States Patent [19]

Przystawik

[11] Patent Number: 4,948,046

[45] Date of Patent: Aug. 14, 1990

[54] THREE WATER PUMP ARRANGEMENT FOR FOUNTAIN DISPLAY

[76] Inventor: Gunter Przystawik, 5230 Tamiami Ct., Cape Coral, Fla. 33904

[21] Appl. No.: 356,464

[22] Filed: May 25, 1989

[51] Int. Cl.[5] ..... B05B 17/08

[52] U.S. Cl. ..... 239/17; 239/23; 137/567; 137/597

[58] Field of Search ..... 239/17, 22, 23; 137/567, 597

[56] References Cited

U.S. PATENT DOCUMENTS

| | | | |
|---|---|---|---|
| 2,787,495 | 4/1957 | Przystawik | 239/17 |
| 3,292,861 | 12/1966 | Kawamura et al. | 239/17 |
| 3,786,835 | 1/1974 | Finger | 137/567 |
| 3,872,887 | 3/1975 | Wohlrab | 137/567 |
| 4,269,352 | 5/1981 | Przystawik | 239/17 |

FOREIGN PATENT DOCUMENTS

| | | | |
|---|---|---|---|
| 1177564 | 9/1964 | Fed. Rep. of Germany | 239/17 |

*Primary Examiner*—Andres Kashnikow
*Assistant Examiner*—Karen B. Merritt
*Attorney, Agent, or Firm*—Merrill N. Johnson

[57] ABSTRACT

A system utilizing at least three separate water pumps for supplying water under pressure to a plurality of nozzles in a fountain display which provides a wide variety of spray heights of the various nozzles. The nozzles are spaced along a main water supply pipe and the pumps are connected to the main water supply pipe at spaced apart entry points along the pipe with a one-way check valve between each pump and the mainwater supply pipe. An independently controllable and incrementally variable gate valve is also located between each pump and the main water supply pipe. Additional versatility and variety of the sprays projected from the nozzles can be obtained by use of additional check valves located along the main water supply pipe between each of the entry points of water supplied by the pumps which pass water under pressure only in one or the other direction.

3 Claims, 1 Drawing Sheet

THREE WATER PUMP ARRANGEMENT FOR FOUNTAIN DISPLAY

BACKGROUND AND SUMMARY OF THE INVENTION

The present invention lies in the field of water fountain displays and especially a water pump arrangement which constitutes an improvement of the arrangement shown and described in my prior U.S. Pat. No. 4,269,352 issued May 26, 1981.

The arrangement described in my prior patent utilized two separately operated motor driven pumps for supplying water to a plurality of fountain display nozzles and a valving arrangement whereby operation of both pumps supplied water to the nozzles at a maximum rate, operation of one pump supplied water at two thirds maximum rate, and operation of the second pump supplied water at one third maximum rate.

While the foregoing arrangement of pumps and valves permitted a variety of rhythmic visual effects in a fountain display, the heights of the water ejected from all the nozzles at any one time was fixed and uniform.

My present invention utilizes three or more pumps and an arrangement of valves which permits a plurality of nozzles to be simultaneously supplied with varying volumes of water to produce at any one time a display of jets of water of varying heights.

My pumps may be driven by electric motors as shown in my prior U.S. Pat. No. 4,269,352 with the motors above the surface of the pool of water containing the fountain display and the pumps themselves beneath the surface of the water. However, my pumps may also be driven by water-submersible motors which I now prefer.

The use of three separately controllable pumps has several advantages. The three pumps can be of the same capacity, while my two pump system required one large capacity pump and one pump of smaller capacity. By using a separate check valve and gate valve for each pump, I can control the height of each of the fountain spray nozzles along the main water supply pipe.

My improved fountain display includes at least four water nozzles spaced along a main water supply pipe and at least three electric motor operated water pumps connected at separate entry points along the main supply pipe and a check valve between each one of the pumps and the main water supply pipe.

My improved fountain display also includes an independently controllable and incrementally variable gate valve located between each pump and the main water supply pipe. The main water supply pipe may also contain a number of check valves located between each of the entry points for water supplied by the pumps.

DETAILED DESCRIPTION OF THE INVENTION

Figure 1:
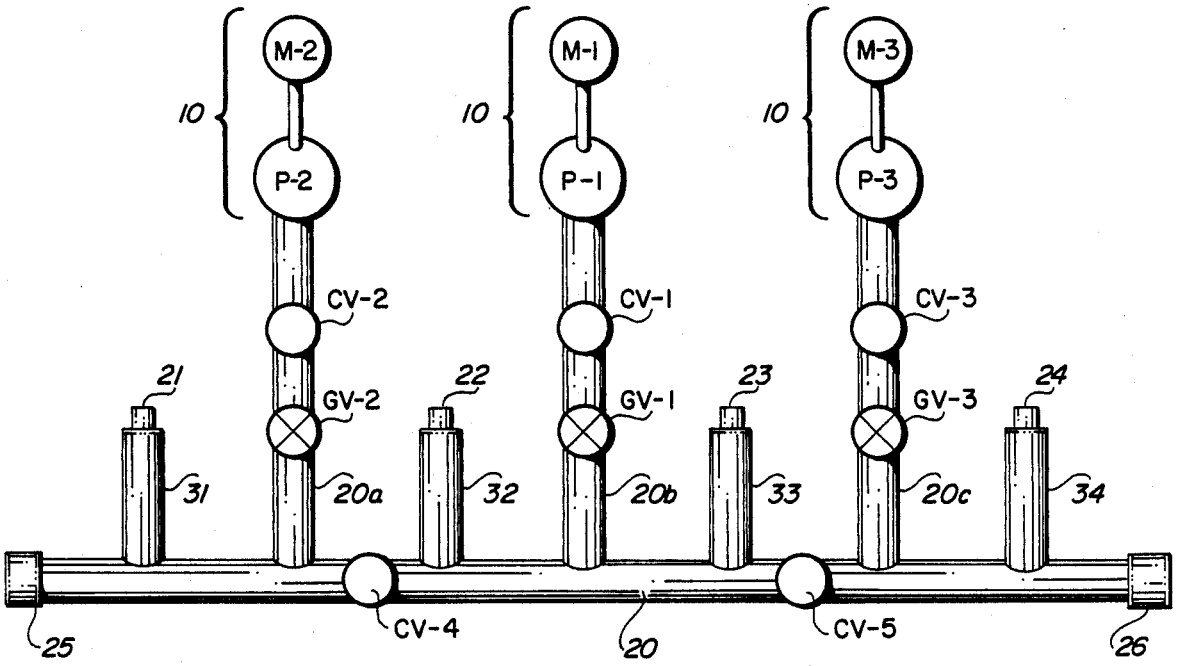
FIG. 1 is a schematic illustration of three electric motor driven water pumps and valving arrangement for supplying water under pressure to a plurality of fountain display nozzles in accordance with my invention.

Referring to the drawings, FIG. 1 shows three similar electric motor driven water pumps 10, each having an electric motor shown as M-1, M-2 and M-3 and a water pump shown as P-1, P-2 and P-3 respectively. Each of water pumps 10 are connected to a main water supply pipe 20 by a separate pipe shown in FIG. 1 as pipes 20*a*, 20*b* and 20*c*.

Spaced along main water supply pipe 20 are four separate water lines 31, 32, 33 and 34 leading to four similar fountain nozzles 21, 22, 23 and 24 respectively as shown in FIG. 1 and in this embodiment of my invention the ends of main water pipe 20 are sealed off by end caps 25 and 26.

Figure 2:
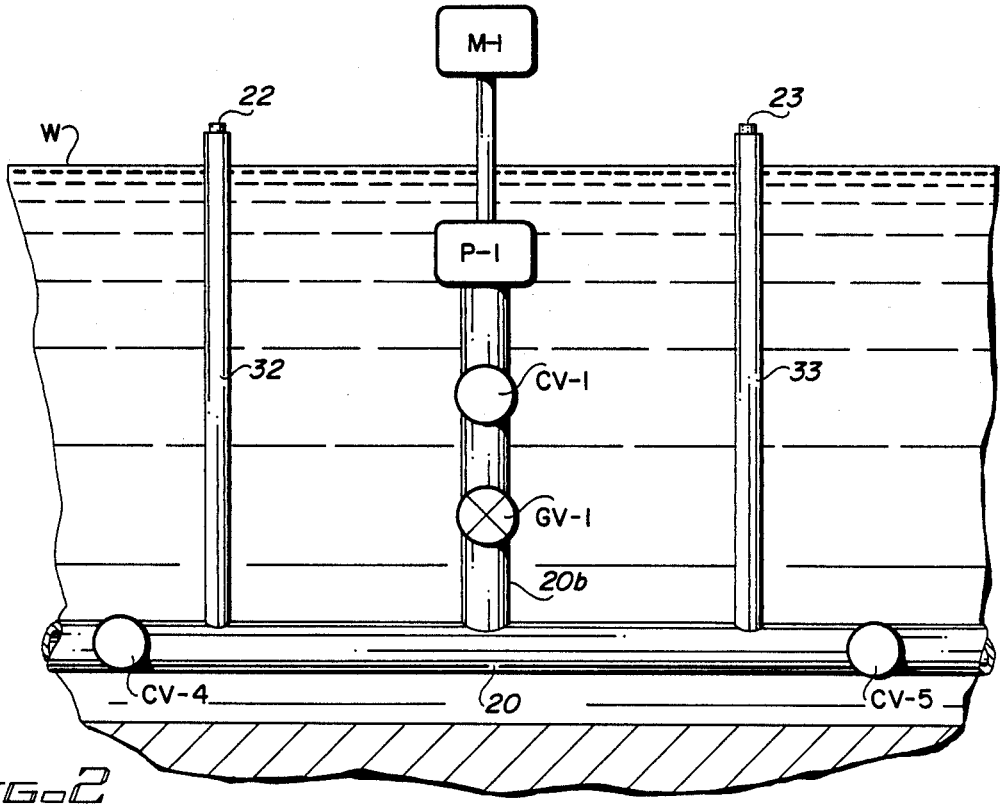
FIG. 2 is a schematic illustration of one of the pumps shown in FIG. 1 with its associated valves in relation to the water level in the fountain pool.

FIG. 2 shows the position of one of the motor driven pumps, namely motor M-1 and pump P-1 and its associated valves in relation to the water W in the fountain pool and also in relation to the position of adjacent fountain nozzles 22 and 23 shown in FIG. 1.

In order to achieve the desired flexibility and variety of sprays of water issuing from nozzles 21, 22, 23 and 24, pumps 10 are connected to the nozzles through a unique system of valves and a preferred embodiment of that arrangement is shown in FIGS. 1 and 2.

Each of pumps 10 is connected to the main water supply pipe 20 through a one-way check valve which are shown in FIG. 1 as valves CV-1, CV-2 and CV-3. Assuming, for purposes of understanding my invention, that no valves other than check valves CV-1, CV-2 and CV-3 were present in the system shown in FIG. 1, the use of three separate pumps provides the following possibilities for varying the height of the fountain sprays:

If all three pumps are operating and all three check valves are open, nozzles 21, 22, 23 and 24 would each project a spray on maximum and equal height.

However, if only pumps P-2 and P-3 are operating and only check valves CV-2 and CV-3 are open, the sprays from each of the four nozzles would be reduced in height to about two-thirds of maximum height.

And if only pump P-1 were operating and thus only check valve CV-1 were open, the sprays from each of the four nozzles would be reduced to about one third their maximum height.

Additional flexibility and variety in the selection of sprays from nozzles 21, 22, 23 and 24 can be achieved by introduction of remotely controllable and incrementally variable gate valves GV-1, GV-2 and GV-3 in pipes 20*b*, 20*a* and 20*c* respectively as shown in FIG. 1. For example, with gate valves GV-2 and GV-3 only half open and gate valve GV-1 fully open and all three pumps operating, the sprays from nozzles 21 and 24 would be only about one third the height of the sprays projected from nozzles 22 and 23. A great variety of different spray heights are possible using this arrangement of pumps, valves and nozzles.

Further versatility in the height of the various sprays from nozzles 21, 22, 23 and 24 can be achieved by use of additional one-way check valves CV-4 and CV-5 in main water supply line 20 located between pipes 20*a* and 32 and pipes 33 and 20*c* respectively. Valves CV-4 and CV-5 can be easily installed so as to pass water under pressure in either one of two directions.

If valve CV-4 is set to pass water under pressure only to the left as shown in FIG. 1 and valve CV-5 is set to pass water under pressure only to the right in FIG. 1 and only pump P-1 is operating, all four nozzles will project sprays to a given equal height. However, if pump P-1 is turned off and only pump P-2 is turned on, nozzle 21 will project a spray to at least three times its height when pump P-1 was operating alone, but there would be no sprays from nozzles 22, 23 and 24. Then, if pump P-1 were turned back on, the spray from nozzles 21 would remain about the same height and the sprays from nozzles 22, 23 and 24 would be at about one half the height of the spray from nozzle 21.

On the other hand, if valve CV-5 is set to pass water only to the right as shown in FIG. 1 and valve CV-5 set to pass water only to the left and pump P-1 only is on, there will be water at maximum height from nozzles 22 and 23, but no sprays from nozzles 21 and 24. However, if pump P-1 is turned off and only P-2 is turned on, nozzles 21, 22 and 23 will project sprays of about one third the height previously achieved by nozzles 22 and 23 when pump P-1 alone was operating. But if pump P-1 and pump P-2 are both operating, nozzles 21, 22 and 23 would obtain maximum and equal height, while again nozzle 24 would not have any spray. And if pump P-1 is turned off and pump P-3 is turned on, each of nozzles 21, 22, 23 and 24 will project sprays about two thirds maximum spray height.

Of course, by varying the openings in the three gate valves GV-1, GV-2 and GV-3 one from the other, an almost endless variety of sprays of differing heights can be achieved by the use of three or more water pumps and associated valves and spray nozzles as hereinbefore described.

While I have herein shown and described a preferred embodiment of my invention, it will be apparent to those skilled in the art of fountain design that various changes and modifications and rearrangements of the pumps, valves and nozzles shown herein can be made without departing from the spirit of my invention whose true scope is defined only in the appended claims.

I claim:

1. A fountain display comprising a plurality of at least four nozzles each connected at spaced intervals along a length of pipe, a plurality of at least three pumps each independently connected at a separate entry point to the length of pipe for supplying liquid under pressure to the pipe and nozzles, a one-way check valve lying between each one of the pumps and the pipe, and an additional one-way check valve located in the pipe between the entry points in the pipe leading to two of the pumps supplying liquid under pressure to the pipe and nozzles.

2. A fountain display comprising a plurality of at least four nozzles each connected at spaced intervals along a length of pipe, a plurality of at least three pumps each independently connected at a separate entry point to the length of pipe for supplying liquid under pressure to the pipe and nozzles, a one-way check valve lying between each one of the pumps and the pipe, an independently controllable and incrementally variable gate valve located between each one of said check valves and the pipe, and two additional one-way check valves, each of said additional check valves being located in the pipe between the entry points in the pipe leading to two of the pumps supplying liquid under pressure to the pipe and the nozzles.

3. A fountain display comprising a plurality of at least four nozzles each connected at spaced intervals to an elongated pipe, a plurality of at least three pumps each independently connected at a separate entry point to the elongated pipe for supplying liquid under pressure to the pipe and nozzles, a one-way check valve lying between each one of the pumps and the pipe, an independently controllable and incrementally variable gate valve located between each one of said check valves and the pipe, and two additional one-way check valves, each one of said additional check valves being located in the pipe between the entry points in the pipe leading to two of the pumps supplying liquid under pressure to the pipe and the nozzles, one of said additional check valves permitting the flow of water in the pipe in one direction and the other additional check valve permitting the flow of water in the pipe in the opposite direction.

* * * * *